US005293001A

United States Patent [19]

Gebs

[11] Patent Number: 5,293,001

[45] Date of Patent: Mar. 8, 1994

[54] FLEXIBLE SHIELDED CABLE

[75] Inventor: Bernhart Allen Gebs, Richmond, Ind.

[73] Assignee: Belden Wire & Cable Company, Richmond, Ind.

[21] Appl. No.: 868,446

[22] Filed: Apr. 14, 1992

[51] Int. Cl.[5] ..... H01B 7/34

[52] U.S. Cl. ..... 174/36; 174/102 K; 174/106 R; 174/102 SC; 174/109

[58] Field of Search ..... 174/36, 106 R, 106 SC, 174/109, 102 R, 102 SC

[56] References Cited

U.S. PATENT DOCUMENTS

| | | | |
|---|---|---|---|
| 2,165,738 | 7/1939 | Van Hoffen | 174/102 SC |
| 3,484,532 | 12/1969 | Anderson | 174/36 |
| 3,643,007 | 2/1972 | Roberts et al. | 174/36 X |
| 4,117,260 | 9/1978 | Wilkenloh | 174/106 |
| 4,408,089 | 10/1983 | Nixon | 174/36 X |
| 4,477,693 | 10/1984 | Krabec et al. | 174/36 |
| 4,486,252 | 12/1984 | Lloyd | 174/36 X |
| 4,584,431 | 4/1986 | Tippie et al. | 174/107 |
| 4,642,417 | 2/1987 | Ruthrof et al. | 174/36 |
| 4,691,081 | 9/1987 | Gupta et al. | 174/105 |
| 4,694,122 | 9/1987 | Visser | 174/106 |
| 4,719,319 | 1/1988 | Tighe, Jr. | 174/103 |
| 4,871,883 | 10/1989 | Guiol | 174/36 |
| 4,970,352 | 11/1990 | Satoh | 174/106 |

*Primary Examiner*—Morris H. Nimmo
*Attorney, Agent, or Firm*—Laff, Whitesel, Conte & Saret

[57] ABSTRACT

A flexible shielded cable that employs a thin metallic foil or plastic metallic foil tape having a metal surface wherein the metallic foil or metal surface is less than 0.0030 inches in thickness disposed about a layer of dielectric material and disposed within a metallic serve or braid. The thin metallic foil prevents or reduces relative movement of the dielectric and the conductor core disposed therein relative to the braid. Preferably, either the metallic foil or braid is a noncopper metal.

14 Claims, 1 Drawing Sheet

FLEXIBLE SHIELDED CABLE

The present invention relates to electrical cables and, more specifically, to a flexible coaxial cable.

BACKGROUND OF THE INVENTION

Various type of flexible cables are heretofore known. U.S. Pat. No. 4,486,252, for example, discloses a coaxial cable comprising a conductor core, a layer of dielectric disposed about the core, and a layer of conductive or semi-conductive matter surrounding the dielectric. A copper shield, which may be braided, is embedded in the layer, and the layer is softened by heating.

Another type of flexible cable heretofore known is disclosed in U.S. Pat. No. 4,694,122. It comprises a flexible metal conductor core, a layer of dielectric positioned about the conductor core, and a flexible copper shield disposed about the dielectric. The metallic shield has a copper foil with overlapping edges and a copper braid disposed about the foil. A layer of metal such as solder, bonds the overlapping edges, bonds the braid and the foil, and encloses the openings of the braids. Although the heretofore known coaxial cables have achieved commercial success, a certain degree of movement of the core relative to the cable still may occur, which may especially be a problem in connection with shorter cable assemblies.

Accordingly, it is an object of this invention to provide a flexible cable assembly that improves upon the prior art.

It is further object to provide a flexible cable assembly that provides a stronger adhesive between the metal shield and the conductor.

SUMMARY OF THE INVENTION

In accordance with these and other objects, a flexible cable assembly is provided that includes a flexible metal conductor, a layer of dielectric positioned about the conductor, and a flexible metallic shield disposed about the dielectric. The shield preferably employs a very thin metallic foil having a thickness less than 0.0030 inches, and a metallic braid, serve, flat/ribbon tape or other type of braid disposed about the foil. Because of the thinness of the foil, a better fit between the braid and the dielectric occurs, which limits relative movement of the dielectric relative to the shield.

In accordance with the invention, the metallic foil or the metallic braid may comprise a metal that is noncopper. For example, a copper foil may be used with a braid that is bronze, plated bronze, nickel, plated nickel, silver, or gold, or instead, a copper braid may be used with a foil that is bronze, silver, nickel or gold.

A preferred embodiment of the invention is seen in the attached drawings, wherein:

DETAILED DESCRIPTION OF THE INVENTION

Figures 1, 2, 3, 4:
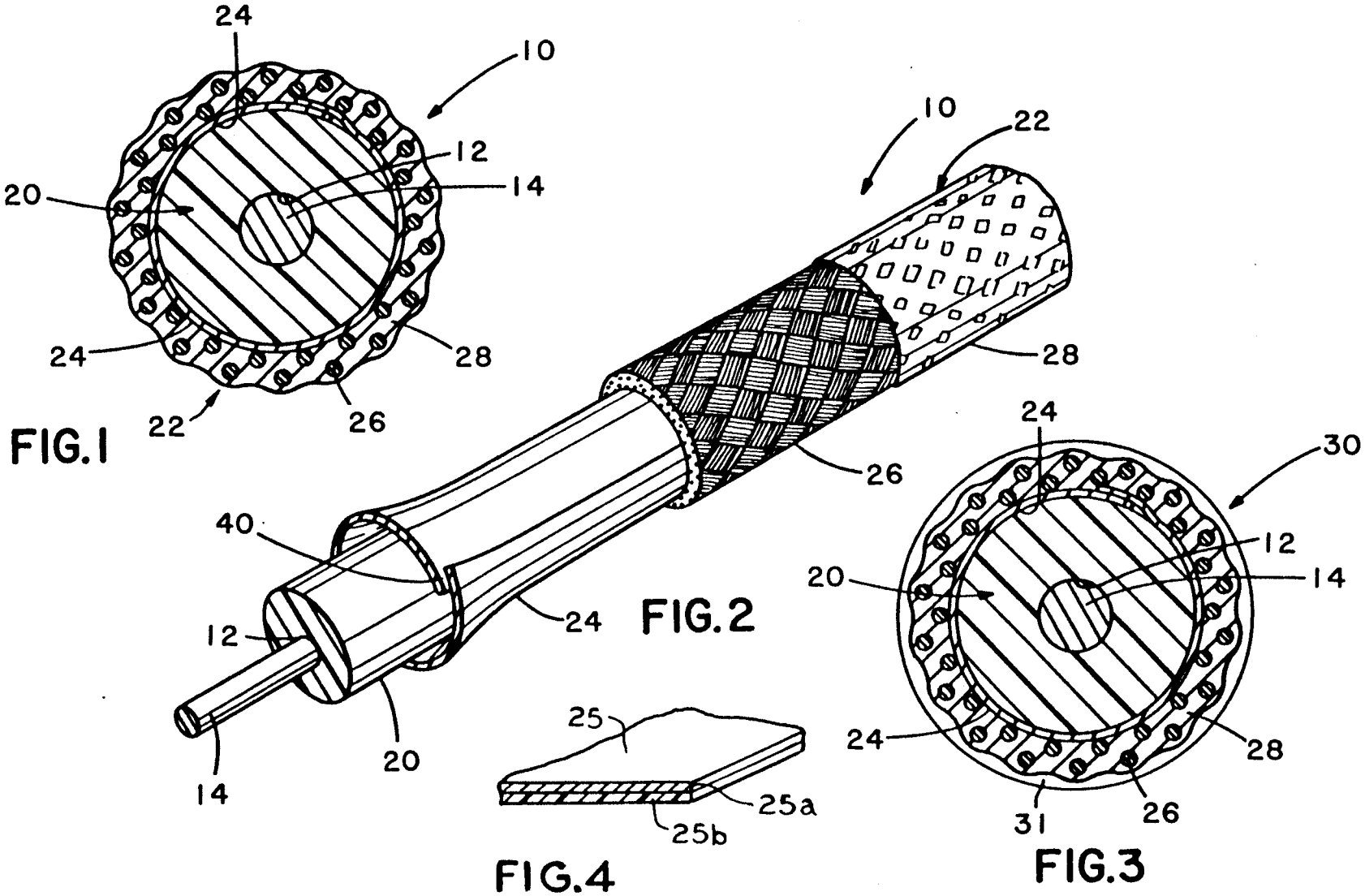
FIG. 1 is a cross section view of a shielded cable in accordance with the invention.
FIG. 2 is a perspective view of the cable of FIG. 1 showing in broken view the various components.
FIG. 3 is a cross-section view of another shield cable in accordance with the invention.
FIG. 4 is an enlarged perspective view of a composite metal foil tape in accordance with one embodiment of the invention.

A flexible shielded cable 10 in accordance with the invention is shown in FIGS. 1 and 2. The cable 10 comprises a core 12 defined by at least one elongate flexible metallic conductor 14 which is preferably copper. In the event that the core 12 is defined by a plurality of conductors 14, preferably, each conductor is insulated from each other.

Disposed about the core 12 is a flexible layer of dielectric material 20 preferably in the form of fluorinated ethylene polymer i.e. Teflon® (Teflon® is a registered trademark of DuPont), or polyethylene, polypropylene, polytetrafluoroethylene, perfluoroalkoxy or cellular forms thereof. Disposed about the dielectric layer 20 is a flexible shield 22.

The flexible shield is composed of: (a) a metal foil tape 24, a composite foil tape 25 or conductive epoxy; (b) a metal braid, serve or flat/ribbon tape, other type of braid 26 wrapped around the foil 24; and (c) a bonding layer 28. The braid may be single or double served.

The metallic foil tape 24 or the metal on the composite metal foil tape 25 has a thickness of less than 0.0030 inches. This small thickness provides a better fit between the braid 26 and dielectric 20 which prevents or reduces the movement of the dielectric 20 relative to the shield 22. As shown in FIG. 2, the metallic foil 24 may have overlapping longitudinally extending edges 40, which are bonded together by a layer of the bonding layer 28. The composite metal foil tape 25, as shown in FIG. 4, is generally prepared by laminating the metal foil **25*a* to a dielectric polymer substrate 25*b*. The substrate 25*b* may have a bonding agent thereon to permit the substrate of the foil tape to be bonded to the dielectric 20 with the metal foil 25*a* facing the braid 26**.

The metallic foil 24 functions to limit high frequency signal penetration, and the metallic braid functions to limit penetration of low frequency signals. The employment of the braid 26 over the foil 24 results in low radio frequency leakage and low susceptibility to electrical noise. The braid 26 being bonded to the foil 24 by the bonding layer 28 also offers several mechanical advantages. The presence of the braid prevents tearing of the foil when the cable 10 is bent. Furthermore, the braid offers a degree of elasticity, permitting the cable to have a higher operating temperature than an otherwise comparable semirigid cable incorporating a shield of copper tubing.

The dielectric layer 20 is preferably formed of flexible thermoplastic polymer such as fluorinated ethylene polymers, i.e. Teflon (a registered trademark of DuPont for synthetic resins containing fluorine), polytetrafluoroethylene, perfluoroalkoxy, polyethylene, polypropylene and cellular forms thereof.

The bonding layer 28 may be a conductive metal or a plastic conductive material such as an epoxy polymer containing conductive agents. The layer of metal 28 is applied by passing the incipient cable through a molten bath of tin or solder. This causes the molten metal (which is drawn in by wicking action—capillary attraction) to fill the braid openings and to close any hairline opening between the overlapping edges 40. During the application of the molten tin or solder component, the foil 24 functions as a heat barrier to insulate the dielectric 20 from a high temperature of the molten metal. But for the foil, the molten metal would directly contact the core insulation material. The use of the foil 24 allows polymers having less heat resistance than Teflon to be used for dielectric layer 20 because the foil conducts heat away from dielectric 20.

The cable 10 is flexible and can be bent without the use of special tools such as are required to prevent kinking or breaking of the cable having a copper tubing shield. Due to its flexible components, the bend radius of the cable 10 is approximately equal to the outside diameter of the cable which is preferably in the range of one to two times the diameter of the cable 10.

The metallic braid 26 includes a flat or ribbon metal type braid or any other suitable configuration rather than the standard round multi-wire braid.

Both the metallic foil 24 and metallic braid 26 may be copper. In accordance with the preferred embodiment of the invention, however, either the metallic foil 24 or metallic braid 26 may be constructed of a metal other than copper. For example, the metallic foil may be copper and the metallic braid may be bronze, plated bronze, nickel, plated nickel, silver or gold. Instead, the metallic braid may be copper and the metallic foil may be bronze, silver, nickel or gold. The metallic foil metallic braid may also be a metal having a copper component such as copper alloy, plated copper, or copper or copper plated covered steel.

Referring to FIG. 3, another embodiment of our invention is shown. In this embodiment, the shielded cable 30 has a plastic jacket 31 extruded thereover. The plastic jacket may be formed of any appropriate plastic material such as polyvinyl chloride, polyethylene, fluorinated ethylene polymers, polytetrafluoroethylene, perfluoroalkoxy, and flame retardant plastic cable jackets.

Those who are skilled in the art will readily perceive how to modify the invention. Therefore, the appended claims are to be construed to cover all equivalent structures which fall within the true scope and spirit of the invention.

I claim:

1. A flexible shielded cable comprising:

at least one elongated flexible metal conductor;

a layer of flexible dielectric material disposed about said conductor;

a thin foil disposed about said layer of flexible dielectric material, said thin foil being selected from a copper foil tape, a copper composite tape and a conductive epoxy, said copper foil tape, the copper layer on said copper composite tape or the conductive epoxy having a thickness of less than 0.0030 inches;

a metallic braid disposed about said thin foil;

a layer of bonding agent bonding said braid and said thin foil; and said metallic braid is selected from the group consisting of bronze, plated bronze, nickel, plated nickel, silver, and gold.

2. A flexible shielded cable comprising:

at least one elongated flexible metal conductor;

a layer of flexible dielectric material disposed about said conductor;

a thin foil disposed about said layer of flexible dielectric material, said thin foil being selected from a copper foil tape, a metal composite tape and a conductive epoxy, said metal foil tape, the metal layer on said metal composite tape or the conductive epoxy having a thickness of less than 0.0030 inches;

a metallic braid disposed about said thin foil; and a layer of bonding agent bonding said braid and said foil;

the metal of said metal foil tape and the metal layer of said metal composite tape being selected from the group consisting of bronze, silver, nickel and gold; and said metallic braid is copper.

3. The cable of claim 1 or 2 wherein said bonding agent is selected from the group consisting of solder, tin, and a conductive polymer.

4. The cable of claim 3 wherein said dielectric material is selected from the group consisting of polyethylene, polypropylene, fluorinated ethylene polymer, polytetrafluoroethylene, perfluoroalkoxy, cellular forms thereof and mixtures thereof.

5. The cable of claim 4 wherein said thin foil is a metal composite tape with a dielectric substrate and a metallic surface, and said substrate bonded to said dielectric material disposed about said conductor.

6. A flexible shielded cable comprising:

at least one elongated flexible metal conductor;

a layer of flexible dielectric material disposed about said conductor;

a conductive epoxy disposed about said layer of flexible dielectric material having a thickness of less than 0.0030 inches;

a metallic braid disposed about said conductive epoxy; and a layer of bonding agent bonding said braid and said conductive epoxy;

said metallic braid is selected from the group consisting of copper, plated copper, copper covered steel, plated copper covered steel, copper alloy, plated copper alloy, bronze, plated bronze, nickel, plated nickel, silver and gold;

said bonding agent is selected from the group consisting of solder, tin, and a conductive polymer; and said dielectric material is selected from the group consisting of polyethylene, polypropylene, fluorinated ethylene polymer, polytetrafluorethylene, perfluoroalkoxy, cellular forms thereof and mixtures thereof.

7. The cable of claim 4 wherein said bonding agent is a conductive epoxy polymer.

8. The cable of claim 4 wherein said braid is a flat/ribbon tape.

9. The cable of claim 4 wherein said braid is single served.

10. The cable of claim 4 wherein said braid is double served.

11. The cable of claim 4 which includes an outer polymer jacket.

12. The cable of claim 4 comprising a plurality of flexible conductors encompassed by said layer of flexible dielectric material, each conductor being insulated from the other conductors.

13. The cable of claim 1 or 2 wherein said metallic braid applies sufficient pressure to said layer of dielectric material to form a mechanical fit with said layer of flexible dielectric.

14. The cable of claim 13 wherein grooves are formed in said layer of dielectric material by said metallic braid.

* * * * *

UNITED STATES PATENT AND TRADEMARK OFFICE

CERTIFICATE OF CORRECTION

PATENT NO. : 5,293,001

DATED : March 8, 1994

INVENTOR(S) : Bernhart Allen Gebs

It is certified that error appears in the above-indentified patent and that said Letters Patent is hereby corrected as shown below:

Column 3,

Line 65, delete "copper" and insert --metal--.

Signed and Sealed this

Twenty-ninth Day of April, 1997

*Attest:*

*Attesting Officer*

BRUCE LEHMAN

*Commissioner of Patents and Trademarks*